US009531049B2

(12) United States Patent
Kroening

(10) Patent No.: US 9,531,049 B2
(45) Date of Patent: Dec. 27, 2016

(54) SYSTEMS AND METHODS FOR RADIO FREQUENCY (RF) ENERGY WAVE SWITCHING USING ASYMMETRICALLY WOUND FERRITE CIRCULATOR ELEMENTS

(71) Applicant: Honeywell International Inc., Morristown, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 207 days.

(21) Appl. No.: 14/563,282

(22) Filed: Dec. 8, 2014

(65) Prior Publication Data

US 2016/0164157 A1 Jun. 9, 2016

(51) Int. Cl.
*H01P 1/39* (2006.01)
*H01P 1/383* (2006.01)
(Continued)

(52) U.S. Cl.
CPC ..... *H01P 1/383* (2013.01); *H01F 27/2823* (2013.01); *H01P 1/39* (2013.01); *H01P 5/16* (2013.01); *H01Q 1/50* (2013.01)

(58) Field of Classification Search
CPC ..... H01P 1/39
(Continued)

(56) References Cited

U.S. PATENT DOCUMENTS 3,185,941 A 5/1965 Freiberg
3,286,201 A 11/1966 Roberts
(Continued)

FOREIGN PATENT DOCUMENTS

EP 2698864 2/2014
EP 2698865 2/2014
(Continued)

OTHER PUBLICATIONS

European Patent Office, "Extended European Search Report from EP Application No. 15179911.1 mailed Dec. 11, 2015", "from foreign counterpart of U.S Appl. No. 14/460,723", Dec. 11, 2015, pp. 1-10, Published in: EP.
(Continued)

*Primary Examiner* — Stephen E Jones
(74) *Attorney, Agent, or Firm* — Fogg & Powers LLC

(57) ABSTRACT

Systems and methods for RF energy wave switching using asymmetrically wound ferrite circulator elements are provided. In one embodiment, a ferrite circulator waveguide switched system comprises: a plurality of ferrite circulator elements coupled together sequentially, the ferrite circulator elements including: a first ferrite circulator element that defines a first port of the switched system; a second ferrite circulator element that defines a second port of the switch system; and an asymmetrically wound ferrite circulator element coupled between the first and second ferrite circulator elements and to an isolation element; and a latch wire threaded through the first ferrite circulator element and the asymmetrically wound ferrite circulator element, wherein the latch wire is wound through the first ferrite circulator element and the asymmetrically wound ferrite circulator element such that a current pulse through the latch wire magnetizes both the first ferrite circulator element and the asymmetrically wound ferrite circulator element.

20 Claims, 7 Drawing Sheets

(51) Int. Cl.

| | |
|---|---|
| ***H01F 27/28*** | (2006.01) |
| ***H01Q 1/50*** | (2006.01) |
| ***H01P 5/16*** | (2006.01) |

(58) Field of Classification Search
USPC ..... 333/1.1, 24.2
See application file for complete search history.

(56) References Cited

U.S. PATENT DOCUMENTS

| | | | |
|---|---|---|---|
| 4,777,454 | A | 10/1988 | Stern et al. |
| 6,885,257 | B2 | 4/2005 | Kroening |
| 7,049,900 | B2 | 5/2006 | Kroening |
| 7,176,767 | B2 | 2/2007 | Kroening |
| 7,230,507 | B2 | 6/2007 | Kroening |
| 7,561,003 | B2 | 7/2009 | Kroening |
| 2003/0107447 | A1 | 6/2003 | Kroening |
| 2014/0049332 | A1 | 2/2014 | Kroening |
| 2014/0049333 | A1 | 2/2014 | Kroening |
| 2016/0049712 | A1 | 2/2016 | Kroening et al. |

FOREIGN PATENT DOCUMENTS

| | | |
|---|---|---|
| EP | 2808939 | 3/2014 |
| WO | 03041213 | 5/2003 |

OTHER PUBLICATIONS

U.S. Patent and Trademark Office, "Notice of Allowance and Fee(s) Due", "U.S. Appl. No. 14/460,723", Feb. 12, 2016, pp. 1-15, Published in: US.

European Patent Office, "Extended European Search Report from EP Application No. 15197397.1 mailed Apr. 26, 2016", "from Foreign Counterpart of U.S. Appl. No. 14/563,282", Apr. 26, 2016, pp. 1-8.

Mesl, "Ka-Band Waveguide Ferrite Switches and Switch Matrices", "Military Microwaves Supplement", Jun. 2006, pp. 62-64.

Kroening et al, "Modular Ferrite Switch for Constructing Switch Networks", "U.S. Appl. No. 13/923,497, filed Jun. 21, 2013", Jun. 21, 2013, pp. 1-33, Published in: US.

Kroening et al., "Multi-Junction Waveguide Circulator Using Dual Control Wires for Multiple Ferrite Elements", "U.S. Appl. No. 14/460,723, filed Aug. 15, 2014", Aug. 15, 2014, pp. 1-33, Published in: US.

SYSTEMS AND METHODS FOR RADIO FREQUENCY (RF) ENERGY WAVE SWITCHING USING ASYMMETRICALLY WOUND FERRITE CIRCULATOR ELEMENTS

BACKGROUND

Problems that affect the operation of ferrite circulator waveguide based switching networks include the leakage of radio frequency (RF) energy out through apertures where latch wires penetrate into and out of the ferrite circulator waveguides, and the picking up of RF energy by the latch wires. Further asymmetric heating of the ferrite element of ferrite circulator waveguides can lead to asymmetric performance of such ferrite circulator waveguides.

For the reasons stated above and for other reasons stated below which will become apparent to those skilled in the art upon reading and understanding the specification, there is a need in the art for alternate systems and methods for RF energy wave switching using asymmetrically wound ferrite circulator elements.

SUMMARY

The Embodiments of the present invention provide methods and systems for RF energy wave switching using asymmetrically wound ferrite circulator elements and will be understood by reading and studying the following specification.

Systems and methods for RF energy wave switching using asymmetrically wound ferrite circulator elements are provided. In one embodiment, a ferrite circulator waveguide switched system comprises: a plurality of ferrite circulator elements coupled together sequentially, the plurality of ferrite circulator elements including: a first ferrite circulator element of the plurality of ferrite circulator elements that defines a first port of the switched system; a second ferrite circulator element of the plurality of ferrite circulator elements comprises a second port of the switch system; and an asymmetrically wound ferrite circulator element of the plurality of ferrite circulator elements coupled between the first ferrite circulator element and the second ferrite circulator element and further coupled to an isolation element. The system further comprises a latch wire threaded through the first ferrite circulator element and the asymmetrically wound ferrite circulator element, wherein the latch wire is wound through the first ferrite circulator element and the asymmetrically wound ferrite circulator element such that a current pulse through the latch wire magnetizes both the first ferrite circulator element and the asymmetrically wound ferrite circulator element.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present disclosure address the needs in the art of ferrite circulator waveguide based switching networks for addressing leakage of radio frequency (RF) energy, induction of RF onto latch wires, and asymmetric heating of the ferrite element of ferrite circulator waveguides through the introduction of asymmetrically wound ferrite circulator elements. Ideally, to reduce the susceptibility of latch wires to picking up RF signals, all latch wiring should be routed to fall within a single plane that runs parallel to the direction of RF travel and perpendicular to the electrical field and is located at a midpoint between the top and bottom of the waveguide. Because of slack in the wiring material, it can be challenging to keep the latch wire parallel, and the longer the span the wire must traverse between ferrite elements, the more the latch wire is exposed and becomes susceptible to picking up RF energy. Further, when multiple latch wires are passed through a single winding aperture to enter and exit the waveguide structure, the diameter of the aperture must be large enough to accommodate the diameters of all the wires, resulting in a geometry where at least part of the aperture remains open allowing RF leakage out of the waveguide. As described in greater detail below, asymmetrically wound ferrite circulator elements permit latch wire routing schemes that can minimize spans and enable the placement of winding apertures that only need to accommodate a single latch wire. Further, as described in greater detail below, asymmetrically wound ferrite circulator elements allow a circuit designer to tailor a flux pattern in ferrite elements to counteract asymmetrical performance characteristics due to non-uniform heating or other causes.

Figure 1:
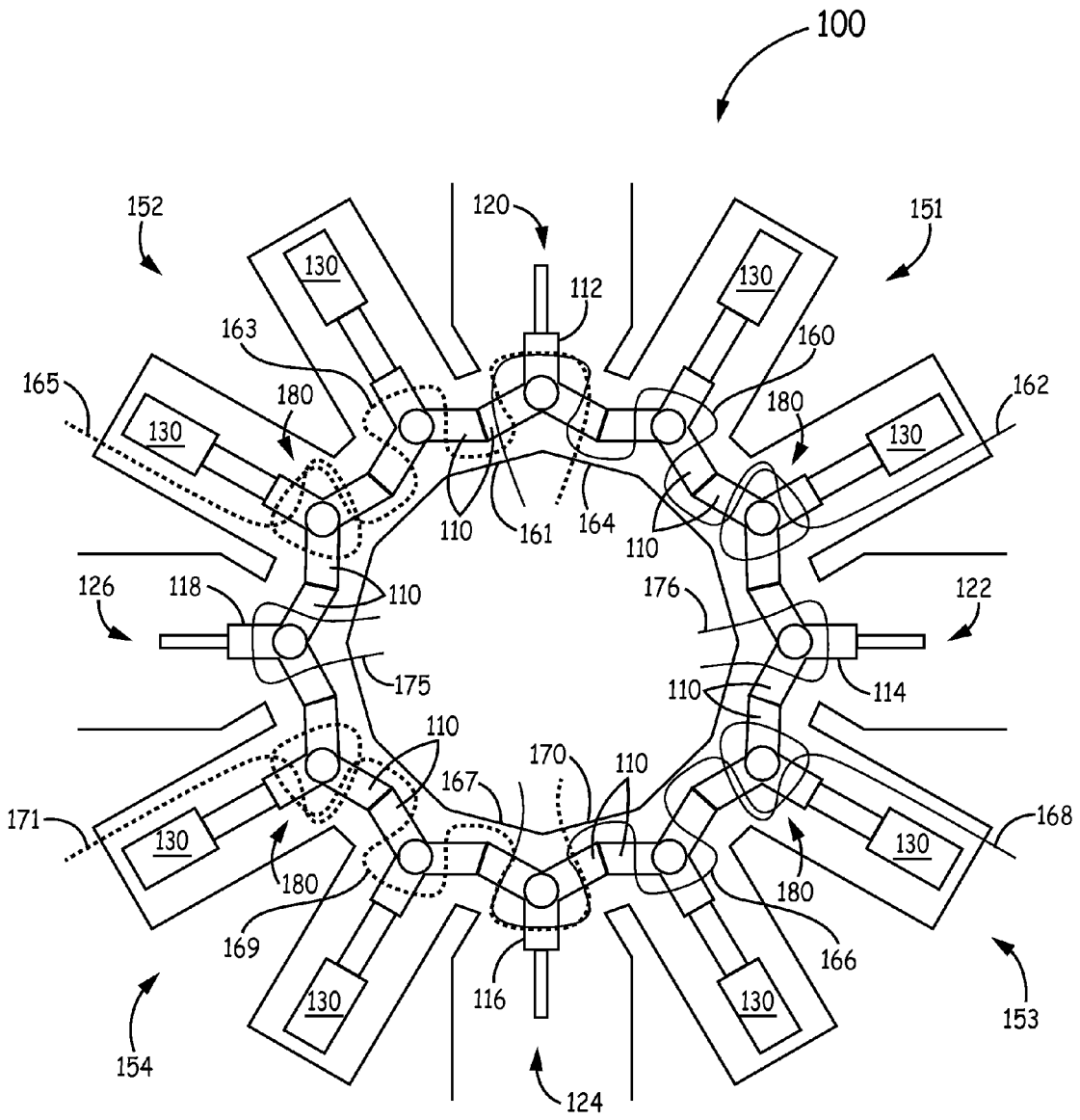
FIG. 1 is a diagram illustrating a switch ring of one embodiment of the present disclosure.

FIG. 1 is a diagram of a radio frequency (RF) waveguide switch ring 100 of one embodiment of the present disclosure. As shown in FIG. 1, the RF waveguide switch ring 100 comprises a plurality of ferrite circulator elements 110 arranged in a closed loop configuration. In the particular embodiment shown in FIG. 1, RF waveguide switch ring 100 is illustrated as a multi junction waveguide circulator utilizing twelve ferrite circulator elements 110. Other embodiments may comprise a fewer, or greater number of ferrite circulator elements 110. In FIG. 1, four of the ferrite circulator elements 110 (referred to as port elements 112, 114, 116 and 118) are configured to function as input and output ports into the switch ring 100. For example, port element 112 may function as a input port 120 where RF energy enters switch ring 100. Depending on the state of each of the plurality of ferrite circulator elements 110 (discussed in greater detail blow), the RF energy entering input port 120 is directed to exit through one of the output ports 122, 124 or 126). The remaining ferrite circulator elements 110 are each coupled to isolation elements 130. Isolation elements consist of absorptive loads and any impedance matching elements, such as dielectric transformers, needed to transition from the ferrite elements to the absorptive loads. The plurality of ferrite circulator elements 110 are further configured so that any RF energy entering RF waveguide switch ring 100 through the output ports 122, 124 or 126 is directed into one of the isolation elements 130, which absorb that RF energy and thereby provide isolation between any components coupled to RF waveguide switch ring 100.

Figure 2:
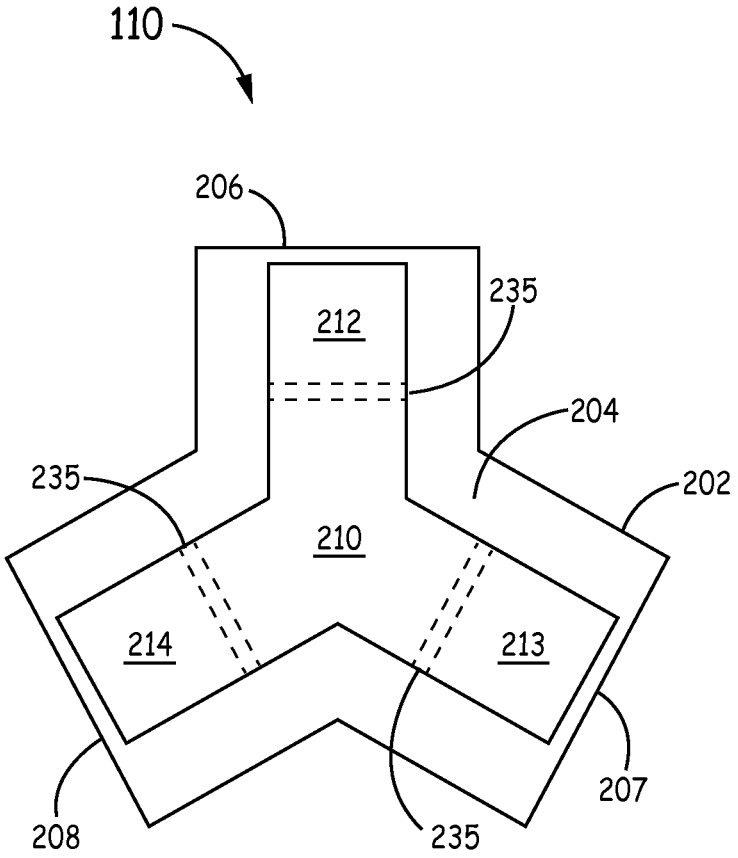
FIG. 2 is a diagram illustrating a ferrite circulator element of one embodiment of the present disclosure.

In one embodiment, each of the remaining ferrite circulator elements 110 are switchable circulators as shown in FIG. 2. As shown in this figure, each of the ferrite circulator elements 110 includes a waveguide structure 202 that comprises a central cavity 204 and has at least a first port 206, a second port 207, and a third port 208 each extending outward from the central cavity 204. A ferrite element 210 having a first leg 212, a second leg 213, and a third leg 214 is disposed within the central cavity 204. The first leg 212 extends into the first port 206, the second leg 213 extends into the second port 207, and the third leg 214 extends into the third port 208. It should be appreciated that in other embodiments, a ferrite circulator element have more than three ports and three legs may be utilized without departing from the intended scope of the present disclosure.

Each of the legs 212, 213 and 214 comprises an aperture 235 through which magnetizing windings, also referred to herein as latch wires, are threaded. The apertures 235 may be created, for example, by boring a hole through each leg (212, 213 and 214) of the ferrite element 210. When a latch wire is inserted through the apertures 235, a magnetizing field can be established in the ferrite element 210. The polarity of this field can be switched back-and-forth by the application of current on the latch wire to create a switchable circulator. Further, each aperture 235 is positioned within a single plane that runs parallel to the direction of RF travel through the waveguide structure 202 and is located at a midpoint between the top and bottom of the waveguide structure 202.

That is, a current or current pulse through the latch wire establishes a magnetic field in the ferrite element 210 that determines the direction of circulation around waveguide structure 202 that RF energy entering the ferrite circulator element 110 follows. Depending on the selected magnetization state of ferrite element 210, the direction of low-loss propagation within ferrite circulator element 110 is either clockwise (CW) or counter-clockwise (CCW). For example, when ferrite element 210 is magnetized to its first (CW) state, RF energy entering port 206 flows CW around waveguide structure 202 and exits port 207, RF energy entering port 207 flows CW around waveguide structure 202 and exits port 208, and RF energy entering port 208 flows CW around waveguide structure 202 and exits port 206. When ferrite element 210 is magnetized to its second (CCW) state, RF energy entering port 206 flows CCW around waveguide structure 202 and exits port 208, RF energy entering port 208 flows CCW around waveguide structure 202 and exits port 207, and RF energy entering port 207 flows CCW around waveguide structure 202 and exits port 206. The direction of current flow in the latch wires threaded through the apertures 235 dictate the magnetization state of the ferrite element 210. It should be noted, however, that current flow through the latch wire does not need to be maintained in order to maintain ferrite element 210 in a particular magnetization state but can be in the form of current pulse. That is, ferrite element 210 maintains an effective remnant magnetization that is a function of the peak current of a previous current pulse through the latch wire.

Referring back to FIG. 1, RF waveguide switch ring 100 comprises segments of multiple ferrite circulator elements 110 that are coupled together and operated by a shared latch wire. Each of these segments are referred to herein as a "switched segment". The embodiment of switch ring 100 shown in FIG. 1 includes four such switch segments generally at 151, 152, 153 and 154.

Switched segment 151 is defined those by those ferrite circulator elements 110 which share latch wire 160. Latch wire 160 enters switch ring 100 through winding aperture 161, is thread through the apertures 235 of each leg of the ferrite circulator elements 110 in switched segment 151, and exits switch ring 100 through winding aperture 162. Switch segment 152 is defined by those ferrite circulator elements 110 which share latch wire 163. Latch wire 163 enters switch ring 100 through winding aperture 164, is thread through the apertures 235 on each leg of the ferrite circulator elements 110 in that segment, and exits switch ring 100 through winding aperture 165. Switched segment 153 is defined those by those ferrite circulator elements 110 which share latch wire 166. Latch wire 166 enters switch ring 100 through winding aperture 167, is thread through the apertures 235 of each leg of the ferrite circulator elements 110 in that sequence, and exit switch ring 100 through winding aperture 168. Switched segment 154 is defined those by those ferrite circulator elements 110 which share latch wire 169. Latch wire 169 enters switch ring 100 through winding aperture 170, is thread through the apertures 235 on each leg of the ferrite circulator elements 110 in that sequence, and exits switch ring 100 through winding aperture 171.

It should be noted that port element 112 at input port 120 is operated by both latch wire 160 and 163. When latch wire 160 is pulsed, port element 112 is switched so that RF energy entering port 120 circulates CCW around port element 112 into segment 152, then circulates CW around each of the ferrite circulator elements 110 to port element 118. The two ferrite elements 110 attached to the isolator elements 130 in segment 152 are only operated by a single latch wire 163, so they are always switched for CW flow from input port 120 to port element 118. Depending on the magnetization state of port element 118 (which is controlled by latch wire 175), the RF energy either exits port 126 or further travels through segment 154 and exits port 124. When latch wire 163 is pulsed, port element 112 is switched so that RF energy entering port 120 circulates CW around port element 112 into segment 151, then circulates CCW around each of the ferrite circulator elements 110 to port element 114. The two ferrite elements 110 attached to the isolator elements 130 in segment 151 are only operated by a single latch wire 160, so they are always switched for CCW flow from input port 120 to port element 114. Depending on the magnetization state of port element 114 (which is controlled by latch wire 176), the RF energy either exits port 122 or further travels through segment 153 and exits port 124. It should also be noted that port element 116 at output port 124 is operated by both latch wires 166 and 169. Since port 124 is an output port in this embodiment rather than an input port, the only expected RF power entering port 124 would be reflected RF power (due to an impedance mismatch, for example, or due to a fault in downstream equipment coupled to output port 124). Therefore port switch 116 may be alternately operated by latch wires 166 and 169 to select which set of isolation elements 130 (that is, the isolation elements 130 of segment 153 or 154) are used to absorb that reflected RF power.

Each of the latch wires 160, 163, 166 and 169 penetrate the waveguide walls of switch ring 100 through their own separate winding apertures 161, 162, 164, 165, 167, 168, 170 and 171. By minimizing the number of latch wires penetrating through a single aperture, the number of propagating RF modes through the wire-filled aperture is reduced, and therefore the undesired RF leakage through the winding aperture is reduced and the insertion loss and noise figure of the switching network are reduced. In other configurations, multiple latch wires may penetrate the waveguide walls through a shared winding aperture. For example, winding apertures 161 and 164 may be combined into a single aperture through which both the first end of latch wire 160 and a first end of latch wire 163 pass.

Further as shown in FIG. 1, each of the of the latch wires 160, 163, 166 and 169 enters switch ring 100 from its interior wall proximate to port elements 112, 114, 116, 118 and exits switch ring 100 from its exterior wall at an asymmetrically wound ferrite circulator element 110 coupled to an isolation element 130 (shown generally at 180). As the term is used in this disclosure, "an asymmetrically wound ferrite circulator element" means that the latch wire thread through the apertures 235 in the ferrite circulator legs 212, 213 and 214 is not thread through the apertures 235 a uniform number of times. Further, the latch wire is threaded from the port element to the asymmetrically wound ferrite circulator element along a route where the latch wire is threaded through the next nearest aperture 235. This "next nearest aperture" routing path minimizes the distances a latch wire needs to span between ferrite elements 110 and therefore minimizes the potential for the latch wire to pick up RF signals.

Figure 3:
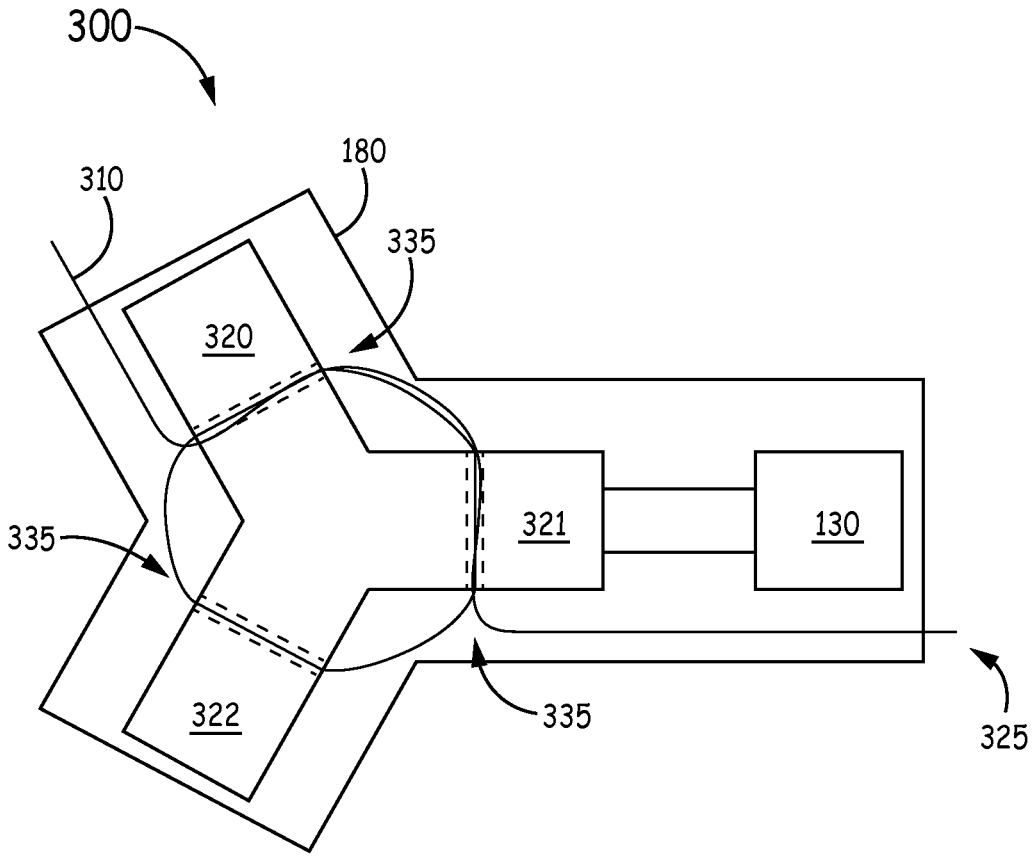
FIG. 3 is a diagram illustrating an asymmetrically wound ferrite circulator element of one embodiment of the present disclosure.

FIG. 3 illustrates an asymmetrically wound ferrite circulator element 300 such as used and shown at 180 in the embodiment of FIG. 1. The latch wire 310 is routed through the apertures 335 of each of the ferrite legs 320, 321 and 322, but is not threaded through the aperture of each leg an equal number of times. That is, latch wire 310 first passes through the aperture of leg 320, then leg 321 and 322 and then passes through the aperture of leg 320 a second time and through the aperture of leg 321 a second lime before exiting. This routing places the latch wire 310 in a position to exit through winding aperture 325 on the exterior circumference of the ring switch.

With a multi junction ferrite circulator, it was previously understood that each leg of the circulator would be wound the same number of times so that the ferrite circulator would demonstrate a symmetrical flux density performance. That is, with a uniform number of winding per leg, the symmetrical flux density would provide for the same performance characteristics (as in return losses, isolation, or insertion losses for example) for all three ports, whether the switch was magnetized to circulate RF energy CW of CCW. With non-uniform winding, a ferrite circulator element might exhibit different performance characteristics for RF energy passing through one leg than another. Therefore by having the latch wire 310 wound through legs 320 and 321 a greater number of times that for leg 322, the former two legs 320 and 321 might be expected to exhibit differences in performance than the latter 322. However, with embodiments of the present disclosure, such concerns may have less importance or are otherwise mitigated. For example, because the asymmetrically wound ferrite circulator elements in the embodiment of FIG. 1 are each coupled to an isolation element 130, the intent is for RF energy passed through leg 321 to be absorbed and performance characteristics are less critical. Further, in some embodiments, the latch wire 310 may be driven with a sufficient peak current to saturate the ferrite material in each of the 320, 321, 322 with only one pass through apertures 325 so that additional turns through an aperture 325 provide for no additional saturation of the ferrite material and therefore have no adverse impact on performance.

Figure 4:
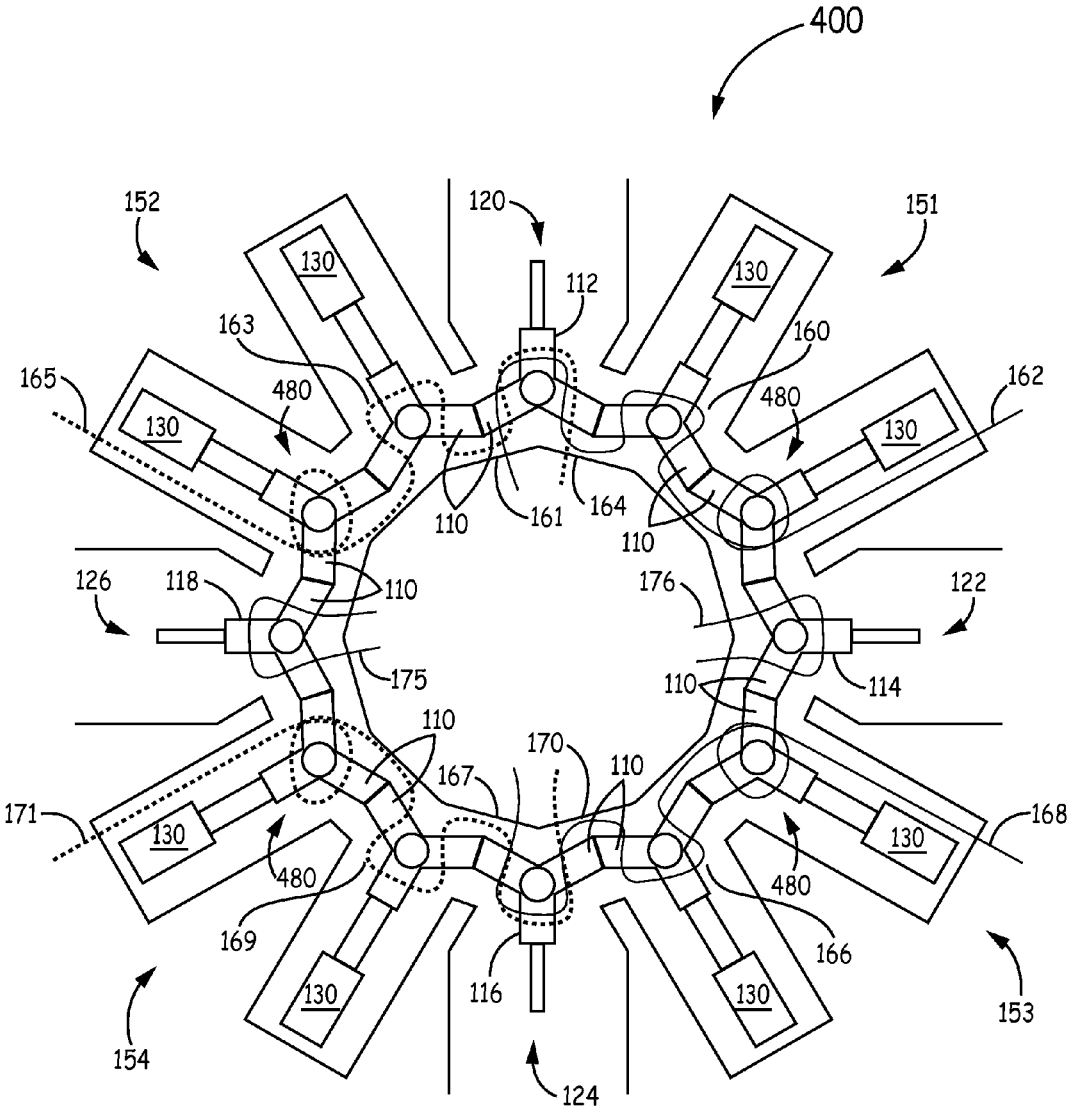
FIG. 4 is a diagram illustrating another switch ring of one embodiment of the present disclosure.

FIG. 4 is an alternate ring switch 400 identical to ring switch 100 except that the asymmetrically wound ferrite circulator elements 110 coupled to an isolation elements 130 (shown generally at 480) are wound slightly differently than those shown at 180 in FIG. 1 and FIG. 3. In this embodiment, instead of having the latch wire threaded from the port element to the asymmetrically wound ferrite circulator element along a route where the latch wire is always threaded through the next nearest aperture 235, the first aperture of the asymmetrically wound ferrite circulator element 480 is passed and the latch wire is then threaded through the first aperture of the asymmetrically wound ferrite circulator element 480 after the passed aperture. This is illustrated in FIG. 5.

Figure 5:
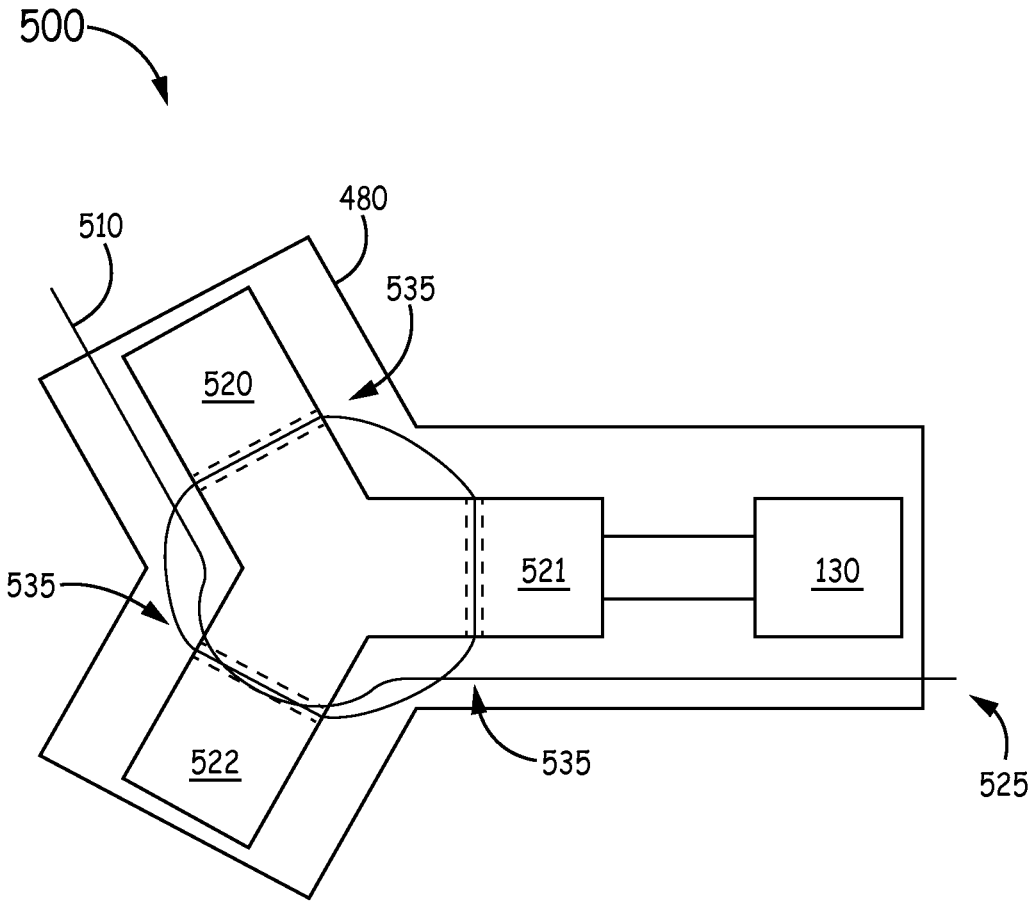
FIG. 5 is a diagram illustrating another asymmetrically wound ferrite circulator element of one embodiment of the present disclosure.

FIG. 5 illustrates an asymmetrically wound ferrite circulator element 500 such as used and shown at 480 in the embodiment of FIG. 4. As before, the latch wire 510 is routed through the apertures 535 of each of the ferrite legs 520, 521 and 522, but is not threaded through the aperture of each leg an equal number of times. In this case, latch wire 510 initially passes by the first encountered aperture 535 of leg 520 but instead first passes through the aperture of leg 522, and is then routed though legs 521 and then 520. Then latch wire 510 passes through the aperture of leg 522 a second time before exiting through winding aperture 525 on the exterior circumference of the ring switch. Although latch wire 510 in such an embodiment will include a longer unsupported span than in the embodiments of FIG. 1, the total length of material needed for latch wire 510 is less and the remaining objectives are still obtained.

Although FIGS. 1-5 illustrate the use of an asymmetrically wound ferrite circulator element as part of a multi junction system of ferrite circulator elements (such as switch rings 100 and 400), still other embodiments are contemplated. For example, FIGS. 6 and 7 are diagrams illustrating different single element ferrite circulator waveguide switched systems of the present disclosure that embody an asymmetrically wound ferrite circulator element.

Figure 6:
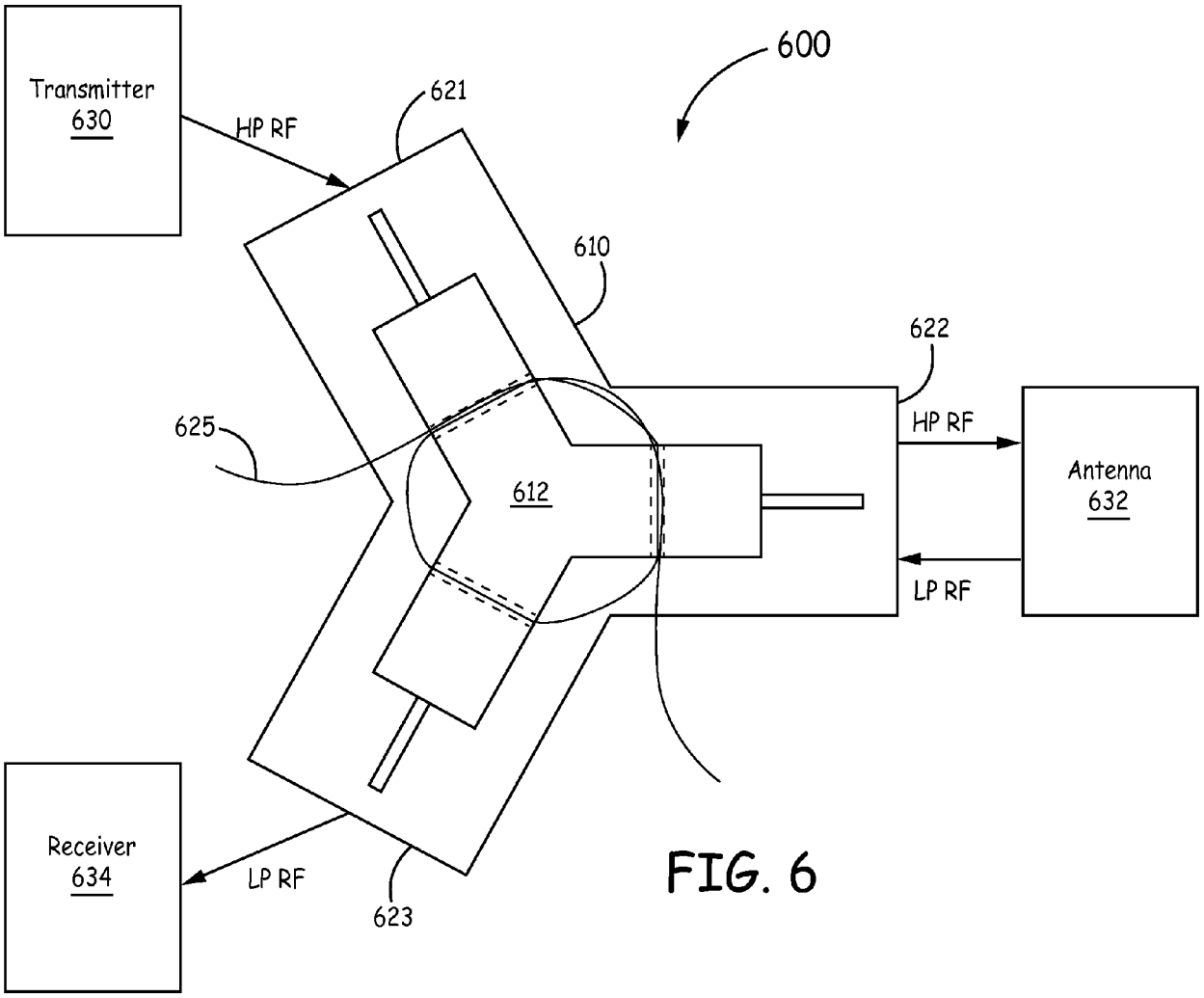
FIG. 6 is a diagram illustrating a ferrite circulator waveguide switched system using an asymmetrically wound ferrite circulator element of one embodiment of the present disclosure.

FIG. 6 is a diagram illustrating a ferrite circulator waveguide switched system 600 using an asymmetrically wound ferrite circulator element 610 of one embodiment of the present disclosure. System 600 illustrates an application where a circuit designer might want slightly asymmetric performance from the three legs of the ferrite circulator element 610. For example, in system 600, a first port 621 of the ferrite circulator element 610 is coupled to an RF transmitter 630, a second port 622 is coupled to an antenna 632, and a third port 623 is coupled to an RF receiver 634. A latch wire 625 supplies a current pulse to magnetize ferrite element 612 so that a high power RF signal received from transmitter 630 on port 621 circulates CW around ferrite circulator element 610 and exits port 622 to antenna 632. Similarly, over the air RF signals received by antenna 632 enter port 622 and (due to the magnetization state of ferrite element 612) circulate CW around ferrite circulator element 610 and exit port 623 to receiver 634. A Radar installation might be one example application of such an embodiment where the RF wave received by system 600 is a reflection of the RF signal transmitted by system 600. In such an application, it should be appreciated that the RF signals received by antenna 632 and circulated to receiver 634 will be lower in power than the RF signal received from transmitter 630 and circulated to antenna 632. Because the signal from the transmitter 630 is a higher power signal, and because ferrite is a poor thermal conductor, two of the three legs of ferrite element 612 (i.e., the legs for port 621 and 622) will be at a higher temperature with respect to the third leg for port 623. Accordingly, relative hot spots in the ferrite material will develop along the transmission path within the ferrite circulator element 610 between ports 621 and 622. It should also be noted that as ferrite material becomes hotter, it is necessary to drive it with a higher peak current through latch wire 625 to get it closer to the same residual magnetic flux density achieved at colder temperatures or lower RF power levels. As such in this embodiment, latch wire 625 is routed to pass through the ferrite legs for ports 621 and 622 a greater number of times than it passes through the ferrite leg for port 623. More specifically, for this example embodiment, latch wire 625 is wound to pass twice through the aperture 635 in the ferrite leg for port 621 and the ferrite leg for port 622, while passing only once thought the aperture 635 in the ferrite leg for port 623. The asymmetric flux produced in ferrite element 612 from non-uniform winding of latch wire 625 counters, at least in part, the asymmetric performance in the ferrite material caused by the non-uniform heating.

Figure 7:
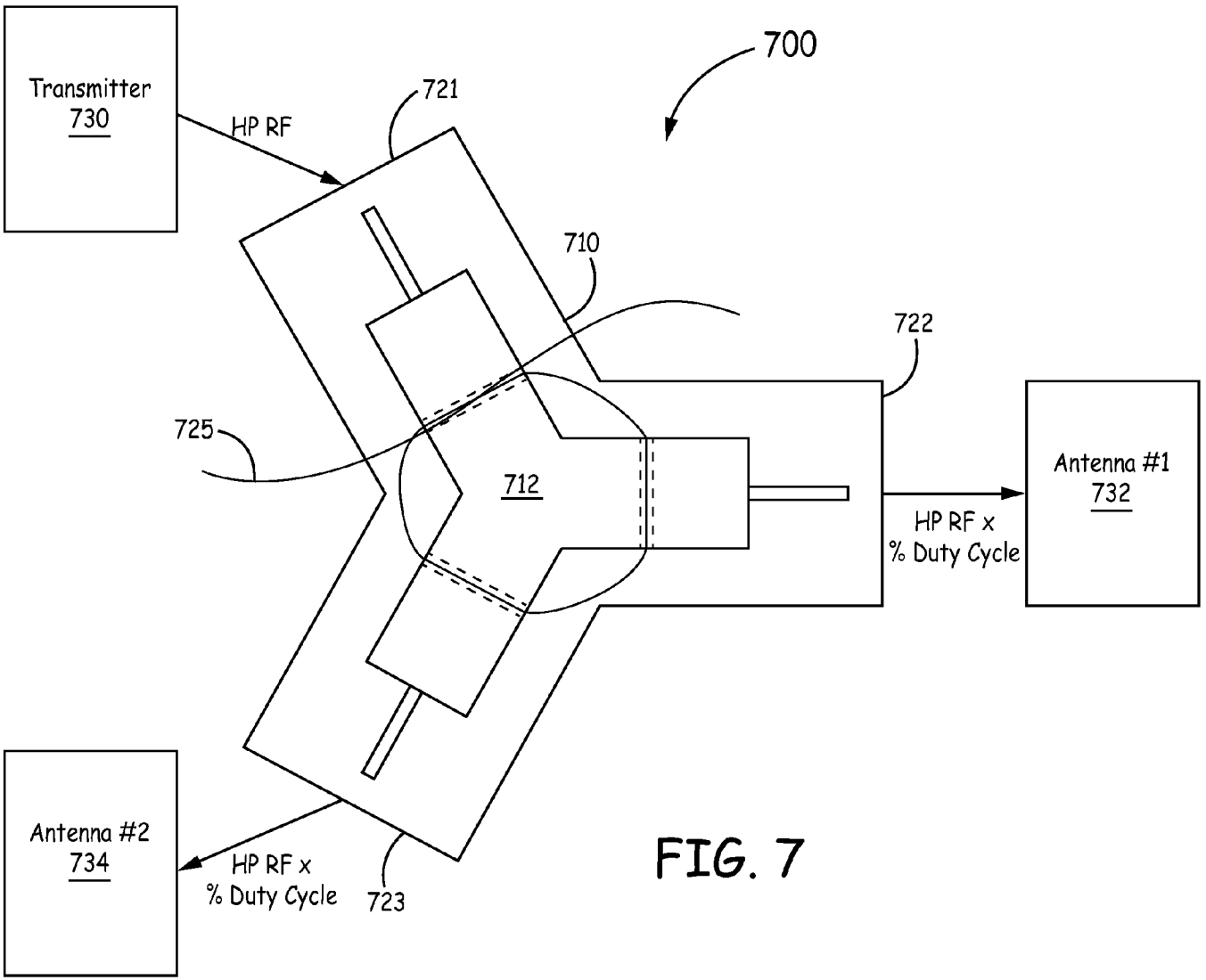
FIG. 7 is a diagram illustrating a ferrite circulator waveguide switched system using an asymmetrically wound ferrite circulator element of one embodiment of the present disclosure.

FIG. 7 is a diagram illustrating another ferrite circulator waveguide switched system 700 using an asymmetrically wound ferrite circulator element 710 of one embodiment of the present disclosure. System 700 illustrates another application where a circuit designer might want slightly asymmetric performance from the three legs of the ferrite circulator element 710. For example, in system 700, a first port 721 of the ferrite circulator element 710 is coupled to an RF transmitter 730, a second port 722 is coupled to a first antenna 732, and a third port 723 is coupled to a second antenna 734. A latch wire 725 supplies a current pulse to magnetize ferrite element 712 so that a high power RF signal received from transmitter 730 on port 721 may be switched between the first antenna 732 and the second antenna 734. In this embodiment, the input port is coupled to a transmit port and each of the other ports output to an antenna. In this embodiment, ferrite circulator element 710 is switched between antenna ports at some duty cycle so that each antenna 732 and 734 (and accordingly the ferrite leg for port 722 and the ferrite leg for port 723) experience a fraction of the RF power that flows through port 721. For example, where latch wire 725 toggles the magnetization state of ferrite element 712 every t microseconds (i.e., a 50% duty cycle), each of the port 722 and 723 will receive approximately ½ the RF power that flows through port 721. Again, because ferrite is a poor thermal conductor, the ferrite material directly receiving the RF signal from transmitter 730 will remain at a relatively higher temperature and hot spots in the ferrite material will develop producing non-uniform performance. Also, as ferrite material becomes hotter, it is necessary to drive it with a higher peak current through latch wire 725 to get it closer to the same residual magnetic flux density achieved at colder temperatures or lower RF power levels. As such in this embodiment, latch wire 725 is routed to pass through the ferrite leg for port 721 a greater number of times than it passes through the ferrite legs for ports 722 and 723. More specifically, for this example embodiment, latch wire 725 is wound to pass twice through the aperture 735 in the ferrite leg for port 721, while passing only once thought the aperture 735 in the ferrite leg for ports 722 and 723. The asymmetric flux produced in ferrite element 712 from this non-uniform winding of latch wire 725 counters, at least in part, the asymmetric performance in the ferrite material caused by the non-uniform heating.

EXAMPLE EMBODIMENTS

Example 1 includes a ferrite circulator waveguide switched system, the system comprising: a plurality of ferrite circulator elements coupled together sequentially, the plurality of ferrite circulator elements including: a first ferrite circulator element of the plurality of ferrite circulator elements that defines a first port of the switched system; a second ferrite circulator element of the plurality of ferrite circulator elements that defines a second port of the switch system; and an asymmetrically wound ferrite circulator element of the plurality of ferrite circulator elements coupled between the first ferrite circulator element and the second ferrite circulator element and further coupled to an isolation element; and a latch wire threaded through the first ferrite circulator element and the asymmetrically wound ferrite circulator element, wherein the latch wire is wound through the first ferrite circulator element and the asymmetrically wound ferrite circulator element such that a current pulse through the latch wire magnetizes both the first ferrite circulator element and the asymmetrically wound ferrite circulator element.

Example 2 includes the system example 1, further comprising: a third ferrite circulator element coupled to a second isolation element, the third ferrite circulator element further coupled in sequence between the first circulator element and the asymmetrically wound ferrite circulator element Example 3 includes the system of any of examples 1-2, wherein the plurality of ferrite circulator elements are arranged in a closed loop configuration.

Example 4 includes the system of any of examples 1-3, wherein the plurality of ferrite circulator elements comprise twelve ferrite circulator elements.

Example 5 includes the system of any of examples 1-4, wherein the asymmetrically wound ferrite circulator element comprises: a waveguide structure comprising a central cavity and having at least a first port, a second port, and a third port each extending outward from the central cavity; a ferrite element having a first leg, a second leg, and a third leg disposed within the central cavity, wherein the first leg extends into the first port, the second leg extends into the second port, and the third leg extends into the third port; wherein the latch wire passes through the first leg, the second leg and the third leg a non-uniform number of times but passes through each of the first leg, the second leg and the third leg at least once.

Example 6 includes the system of example 5, wherein the first port couples the asymmetrically wound ferrite circulator element to the first ferrite circulator element, the second port couples the asymmetrically wound ferrite circulator element to the isolation element, and the third port couples the asymmetrically wound ferrite circulator element to the second ferrite circulator element.

Example 7 includes the system of example 6, wherein the latch wire passes through the first leg, the second leg and the third leg at least once, and wherein the latch wire further passes through the first leg and second leg at least once more than it passes through the third leg.

Example 8 includes the system of any example 6, wherein the latch wire passes through the first leg, the second leg and the third leg at least once, and wherein the latch wire further passes through the third leg at least once more than it passes through the first leg and the second leg.

Example 9 includes the system of any of examples 1-8, wherein at least one of the plurality of ferrite circulator elements comprises more than three ports.

Example 10 includes the system of any of examples 1-9, wherein the latch wire penetrates a waveguide structure of the first ferrite circulator through a first winding aperture; and wherein the latch wire penetrates a waveguide structure of the asymmetrically wound ferrite circulator element through a second winding aperture, wherein the latch wire is the only wire routed through the second winding aperture.

Example 11 includes the system of example 10, wherein the plurality of ferrite circulator elements are arranged in a closed loop configuration; wherein the latch wire penetrates the waveguide structure of the first ferrite circulator through the first winding aperture at an interior wall of the closed loop configuration; and wherein the latch wire penetrates the waveguide structure of the asymmetrically wound ferrite circulator element through the second winding aperture at an exterior wall of the closed loop configuration.

Example 12 includes the system of any of examples 5-11, wherein the latch wire passes through the first leg, the second leg and the third leg through an aperture in each respective leg positioned in a plane that runs parallel to a direction of RF travel and positioned at a midpoint between a top and a bottom of the waveguide structure Example 13 includes the system of any of examples 5-12, wherein the first ferrite circulator element of the plurality of ferrite circulator elements defines an input port of the switched system; and the second ferrite circulator element of the plurality of ferrite circulator elements comprises an output port of the switch system.

Example 14 includes a ferrite circulator waveguide switched system, the system comprising: a waveguide structure comprising a central cavity and having at least a first port, a second port, and a third port each extending outward from the central cavity; a ferrite element having a first leg, a second leg, and a third leg disposed within the central cavity, wherein the first leg extends into the first port, the second leg extends into the second port, and the third leg extends into the third port; wherein a latch wire passes through the first leg, the second leg and the third leg a non-uniform number of times, but passes through each of the first leg, the second leg and the third leg at least once.

Example 15 includes the system of example 14, wherein the latch wire that passes through the first leg, the second leg and the third leg at least once, and wherein the latch wire further passes through the first leg at least once more than it passes through the third leg.

Example 16 includes the system of any of examples 14-15, wherein the first port is coupled to a radio frequency (RF) transmitter, the second port is coupled to a first antenna, the third port is coupled to a second antenna; and wherein the latch wire is alternately energized with currents of opposing polarity to switch a radio frequency (RF) signal received at the first port between the second port and the third port.

Example 17 includes the system of example 16, wherein the latch wire is alternately energized with currents of opposing polarity at a predetermined duty cycle.

Example 18 includes the system of any of example 14, wherein the first port is coupled to a radio frequency (RF) transmitter, the second port is coupled to an antenna, and the third port is coupled to a RF receiver.

Example 19 includes the system of example 18, wherein the latch wire passes through the first leg and the second leg at least once more than it passes through the third leg.

Example 20 includes the system of any of examples 14-19, wherein the latch wire passes through the first leg, the second leg and the third leg through an aperture in each respective leg positioned in a plane that runs parallel to a direction of RF travel and positioned at a midpoint between a top and a bottom of the waveguide structure.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A ferrite circulator waveguide switched system, the system comprising:

a plurality of ferrite circulator elements coupled together sequentially, the plurality of ferrite circulator elements including:

a first ferrite circulator element of the plurality of ferrite circulator elements that defines a first port of the switched system;

a second ferrite circulator element of the plurality of ferrite circulator elements that defines a second port of the switch system; and an asymmetrically wound ferrite circulator element of the plurality of ferrite circulator elements coupled between the first ferrite circulator element and the second ferrite circulator element and further coupled to an isolation element; and a latch wire threaded through the first ferrite circulator element and the asymmetrically wound ferrite circulator element, wherein the latch wire is wound through the first ferrite circulator element and the asymmetrically wound ferrite circulator element such that a current pulse through the latch wire magnetizes both the first ferrite circulator element and the asymmetrically wound ferrite circulator element.

2. The system of claim 1, further comprising:

a third ferrite circulator element coupled to a second isolation element, the third ferrite circulator element further coupled in sequence between the first circulator element and the asymmetrically wound ferrite circulator element.

3. The system of claim 1, wherein the plurality of ferrite circulator elements are arranged in a closed loop configuration.

4. The system of claim 1, wherein the plurality of ferrite circulator elements comprise twelve ferrite circulator elements.

5. The system of claim 1, wherein at least one of the plurality of ferrite circulator elements comprises more than three ports.

6. The system of claim 1, wherein the latch wire penetrates a waveguide structure of the first ferrite circulator through a first winding aperture; and wherein the latch wire penetrates a waveguide structure of the asymmetrically wound ferrite circulator element through a second winding aperture, wherein the latch wire is the only wire routed through the second winding aperture.

7. The system of claim 6, wherein the plurality of ferrite circulator elements are arranged in a closed loop configuration;

wherein the latch wire penetrates the waveguide structure of the first ferrite circulator through the first winding aperture at an interior wall of the closed loop configuration; and wherein the latch wire penetrates the waveguide structure of the asymmetrically wound ferrite circulator element through the second winding aperture at an exterior wall of the closed loop configuration.

8. The system of claim 1, wherein the asymmetrically wound ferrite circulator element comprises:

a waveguide structure comprising a central cavity and having at least a first port, a second port, and a third port each extending outward from the central cavity;

a ferrite element having a first leg, a second leg, and a third leg disposed within the central cavity, wherein the first leg extends into the first port, the second leg extends into the second port, and the third leg extends into the third port;

wherein the latch wire passes through the first leg, the second leg and the third leg a non-uniform number of times but passes through each of the first leg, the second leg and the third leg at least once.

9. The system of claim 8, wherein the latch wire passes through the first leg, the second leg and the third leg through an aperture in each respective leg positioned in a plane that runs parallel to a direction of RF travel and positioned at a midpoint between a top and a bottom of the waveguide structure.

10. The system of claim 8, wherein the first ferrite circulator element of the plurality of ferrite circulator elements defines an input port of the switched system; and the second ferrite circulator element of the plurality of ferrite circulator elements comprises an output port of the switch system.

11. The system of claim 8, wherein the first port couples the asymmetrically wound ferrite circulator element to the first ferrite circulator element, the second port couples the asymmetrically wound ferrite circulator element to the isolation element, and the third port couples the asymmetrically wound ferrite circulator element to the second ferrite circulator element.

12. The system of claim 11, wherein the latch wire passes through the first leg, the second leg and the third leg at least once, and wherein the latch wire further passes through the first leg and second leg at least once more than it passes through the third leg.

13. The system of claim 11, wherein the latch wire passes through the first leg, the second leg and the third leg at least once, and wherein the latch wire further passes through the third leg at least once more than it passes through the first leg and the second leg.

14. A ferrite circulator waveguide switched system, the system comprising:

a waveguide structure comprising a central cavity and having at least a first port, a second port, and a third port each extending outward from the central cavity;

a ferrite element having a first leg, a second leg, and a third leg disposed within the central cavity, wherein the first leg extends into the first port, the second leg extends into the second port, and the third leg extends into the third port;

wherein a latch wire passes through the first leg, the second leg and the third leg a non-uniform number of times, but passes through each of the first leg, the second leg and the third leg at least once.

15. The system of claim 14, wherein the latch wire that passes through the first leg, the second leg and the third leg at least once, and wherein the latch wire further passes through the first leg at least once more than it passes through the third leg.

16. The system of claim 14, wherein the latch wire passes through the first leg, the second leg and the third leg through an aperture in each respective leg positioned in a plane that runs parallel to a direction of RF travel and positioned at a midpoint between a top and a bottom of the waveguide structure.

17. The system of claim 14, wherein the first port is coupled to a radio frequency (RF) transmitter, the second port is coupled to a first antenna, the third port is coupled to a second antenna; and wherein the latch wire is alternately energized with currents of opposing polarity to switch a radio frequency (RF) signal received at the first port between the second port and the third port.

18. The system of claim 16, wherein the latch wire is alternately energized with currents of opposing polarity at a predetermined duty cycle.

19. The system of claim 14, wherein the first port is coupled to a radio frequency (RF) transmitter, the second port is coupled to an antenna, and the third port is coupled to a RF receiver.

20. The system of claim 19, wherein the latch wire passes through the first leg and the second leg at least once more than it passes through the third leg.

* * * * *